US005177713A

United States Patent [19]

Doughty

[11] Patent Number: 5,177,713

[45] Date of Patent: Jan. 5, 1993

[54] MOTORIZED SLIDE STICK CALENDAR

[76] Inventor: Edwin J. Doughty, 3865 N. Thomas Rd., Freeland, Mich. 48623

[21] Appl. No.: 712,458

[22] Filed: Jun. 10, 1991

[51] Int. Cl.[5] ..... G04B 19/24; G09D 3/10

[52] U.S. Cl. ..... 368/28; 368/40; 40/109

[58] Field of Search ..... 368/28, 39, 40; 40/107, 40/109

[56] References Cited

U.S. PATENT DOCUMENTS

| | | | |
|---|---|---|---|
| 192,118 | 6/1877 | Gale . | |
| 209,453 | 10/1878 | Bryant et al. . | |
| 249,536 | 11/1881 | Lewis . | |
| 256,255 | 4/1882 | Votti . | |
| 422,090 | 2/1890 | Miller . | |
| 476,263 | 6/1892 | Guidinger . | |
| 557,743 | 2/1896 | Winiker | 368/40 |
| 885,222 | 4/1908 | Borland . | |
| 1,154,997 | 9/1915 | Markham . | |
| 1,373,744 | 4/1921 | Kelly | 40/109 |
| 2,227,362 | 12/1940 | Parr et al. | 368/40 |
| 3,353,347 | 11/1967 | Gates et al. | 368/28 |
| 3,603,073 | 9/1971 | Terada et al. | 368/40 |
| 4,484,402 | 11/1984 | Kebe | 40/107 |

*Primary Examiner*—Vit W. Miska

*Attorney, Agent, or Firm*—Learman & McCulloch

[57] ABSTRACT

A motorized slide stick calendar has a wall mount with a series of side by side slide openings and a datum. A day slide, with longitudinally spaced days of the week indicia, a month slide with month indicia and a date slide, with longitudinally spaced numbers designating days of the month are each received in separate slide openings. A clock motor is connected to index the slides relative to the datum to display the current month, day and date at the datum.

21 Claims, 6 Drawing Sheets

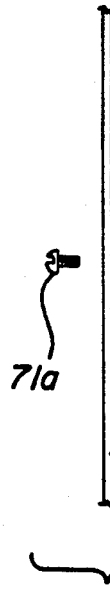
FIG-16
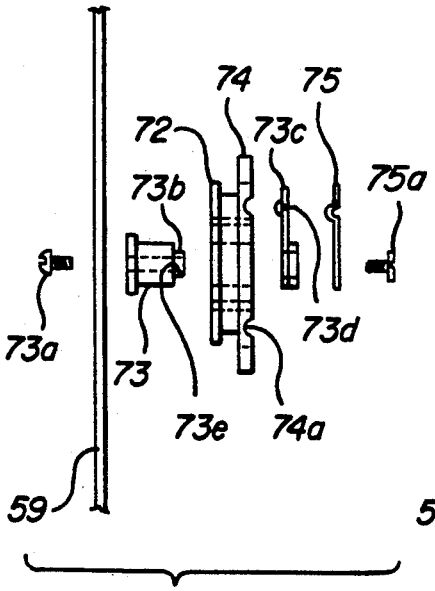
FIG-17
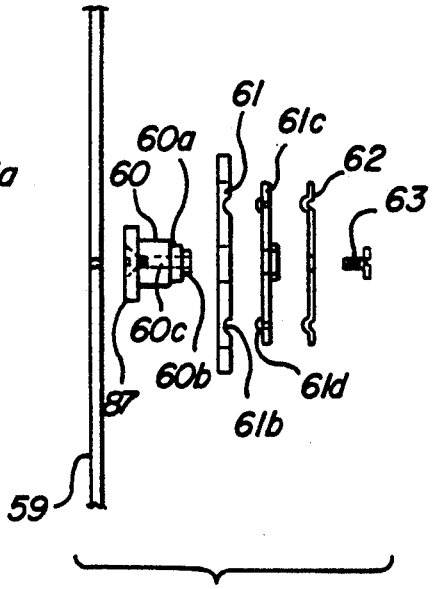
FIG-18
FIG-20
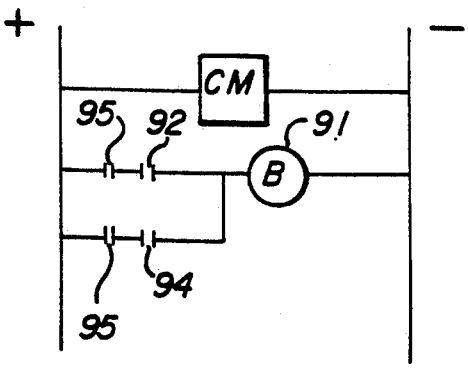
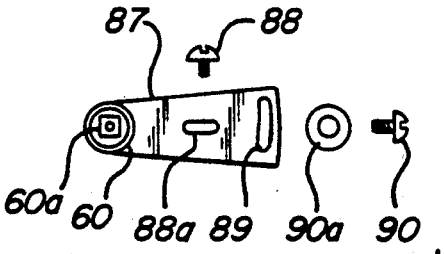
FIG-19
FIG-2
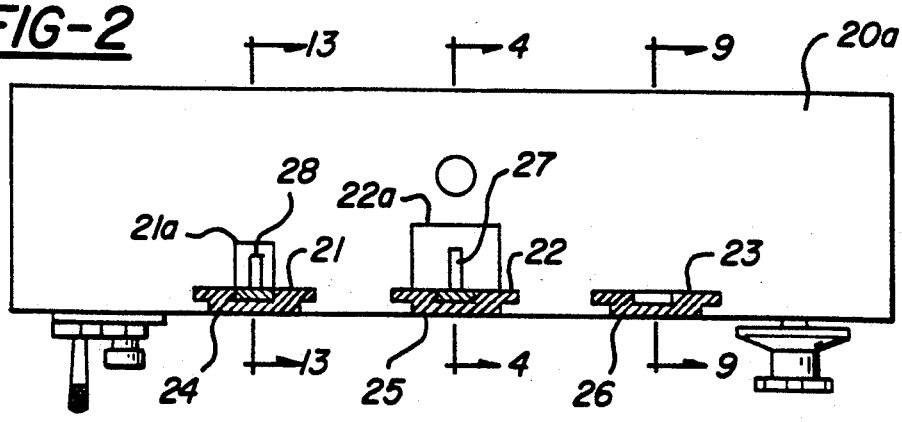

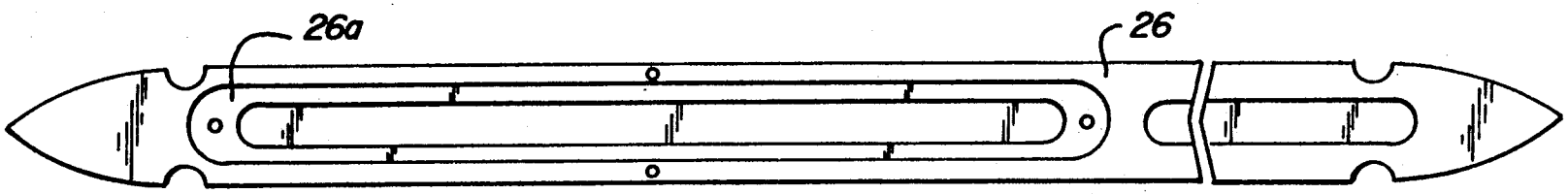
FIG-8
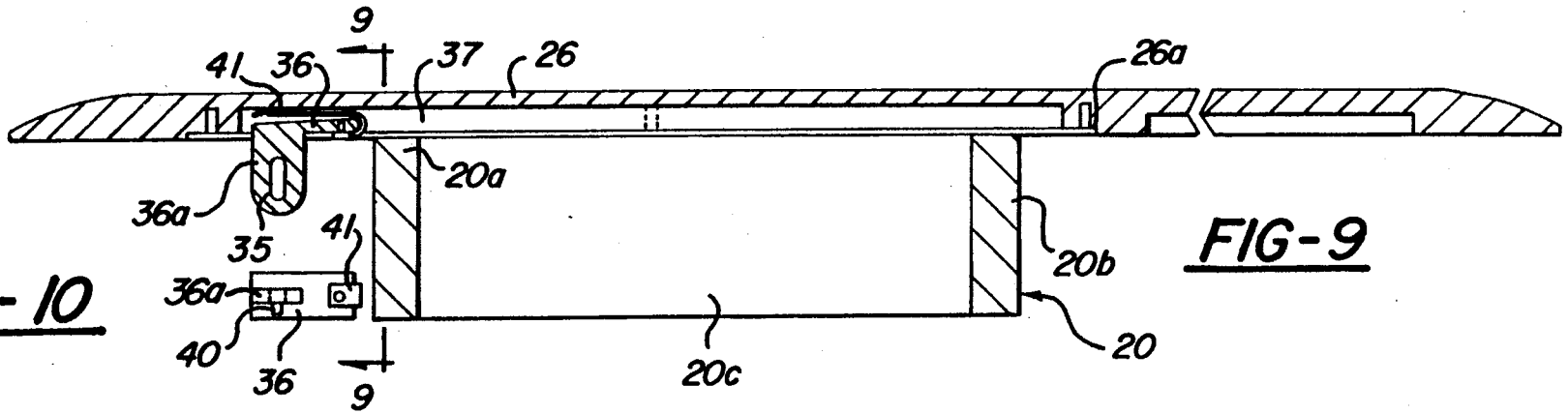
FIG-9
FIG-10
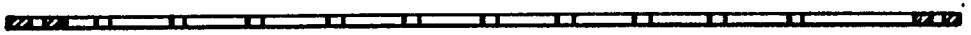
FIG-12
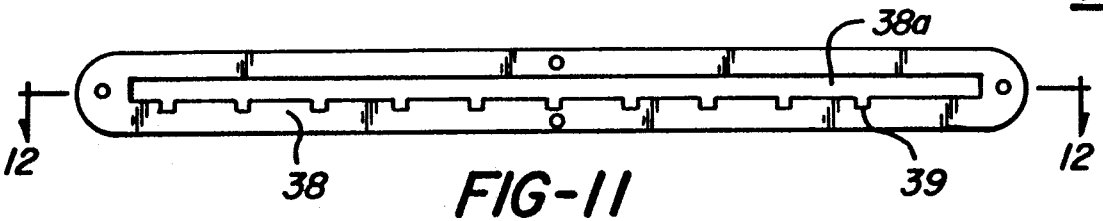
FIG-11

MOTORIZED SLIDE STICK CALENDAR

BACKGROUND OF THE INVENTION

The present invention relates to slide stick calendars of the type which were used in medieval times to keep track of the days of the week, dates of the month and the months. Today perpetual calendars of this type are sold as novelty items which can be mounted on the wall in homes and offices. The date and day slide sticks of such calendars need to be manually manipulated daily and, of course, frequently, this is not possible to do on a daily basis. In other instances, owners of the calendars simply forget to manipulate them. Typical of patents comprising the technology which relates to such wall calendars are the following:

U.S. Pat. No. 192,118, Gale
U.S. Pat. No. 209,453, Bryant et al
U.S. Pat. No. 249,536, Lewis
U.S. Pat. No. 256,255, Votti
U.S. Pat. No. 422,090, Miller
U.S. Pat. No. 476,263, Guidinger
U.S. Pat. No. 557,743, Winiker
U.S. Pat. No. 885,222, Borland
U.S. Pat. No. 1,154,997, Markham Of these patents, the Markham U.S. Pat. No. 1,154,997 utilizes gearing for manipulating its slides and it is believed that this gearing is meant to be connected to some kind of a hand crank since the calendar is apparently a large wall calendar used in railway stations for the benefit of the traveling public. The Winiker U.S. Pat. No. 557,743, utilizes a clock to power an indicator which travels along a row of date indicia to designate the date of the month. The indicia are fixed and a month designator is initially manually adjusted at the beginning of each month. None of these patents employ a clock motor to power the day, date and month slides and, accordingly, none of them seek to solve the problem presented by the fact that there are different numbers of days in some months than others, and in leap years February has twenty-nine days instead of twenty-eight.

SUMMARY OF THE INVENTION

The improved perpetual wall calendar which is first generally, and then particularly, discussed herein, provides drive relationships between day, date and month slides which will be further specifically described. One of the problems solved is that of providing an interrelationship between clock-driven day and date slides, which provides a relative adjustment between them.

One of the prime objects of the invention is to provide a clock-driven wall calendar having multiple clock-driven slides.

Another object of the invention is to provide a wall calendar of this character wherein one of the slides is directly driven, and there are drive relationships between the others which permits the calendar owner to adjust at the beginning of the month, if need be, for the fact that the current month may have a different number of days than the preceding month.

Another object of the invention is to provide a clock driven perpetual calendar of the type described having a powered month of the year indicating slide which operates for a year at a time without the need for attention.

Still another object of the invention is to provide a very attractive, preferably battery operated, clock-driven slide calendar of the character described, which is capable of performing alarm functions.

Another object of the invention is to provide a reliable, clock-driven slide calendar which can be readily and economically manufactured and marketed.

Other objects and advantages of the invention will be pointed out specifically or will become apparent from the following description when it is considered in conjunction with the appended claims and the accompanying drawings.

GENERAL DESCRIPTION OF THE DRAWINGS

In the drawings, FIG. 1 is a front elevational view of the motorized slide stick calendar assembly;

FIG. 2 is a sectional plan view, taken generally on the lines 2—2 of FIG. 1;

FIG. 8 is a rear elevational view of the day slide only;

FIG. 9 is a schematic, sectional elevational view taken on the line 9—9 of FIG. 1, various parts being omitted in the interests of clarity;

FIG. 10 is a top plan view of a sub-slide employed with the day slide;

FIG. 11 is a rear elevational view of the retention plate used on the day slide;

FIG. 12 is a sectional view taken on the line 12—12 of FIG. 11;

FIG. 16 is an exploded, side elevational view of the parts constituting the month advancing, drive gear assembly;

FIG. 17 is an exploded, side elevational view of the parts constituting the month advancing wheel assembly;

FIG. 18 is an exploded elevational view of the parts constituting the date advancing wheel assembly;

FIG. 19 is an exploded view of the parts constituting the platform on which the advancing wheel assembly is mounted; and FIG. 20 is a schematic electrical control circuit.

Figure 1:
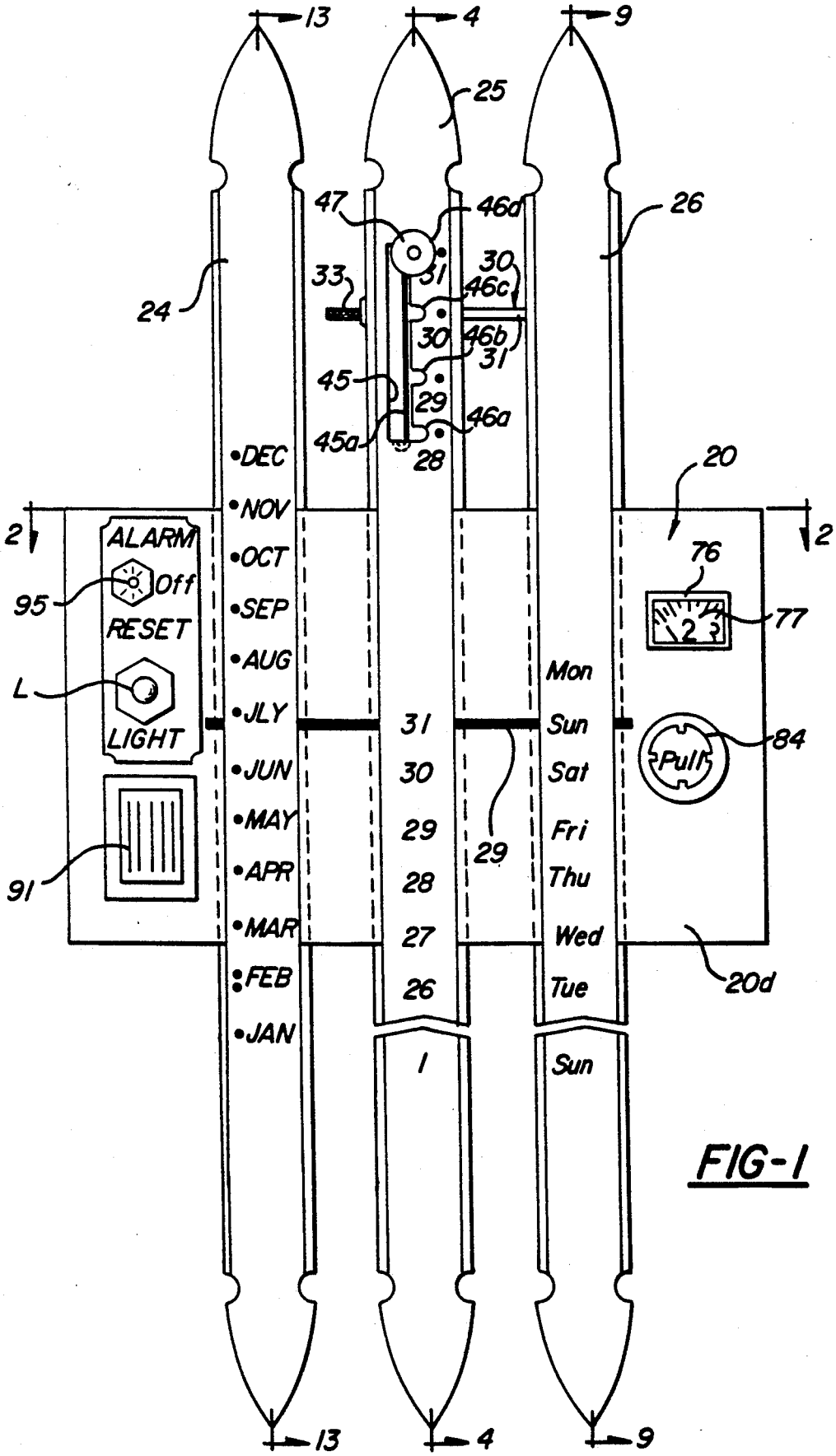

Referring now more particularly to the accompanying drawings, and in the first instance to FIGS. 1 and 9, a wall mount base, generally designated 20, is shown as a housing comprising top and bottom walls **20*a* and 20*b* respectively, end walls 20*c*, and a front wall 20*d*. Provided in the top wall 20*a*, adjacent the front wall 20*d* and opening thereto, are T-slots 21, 22 and 23 (FIG. 2) for accommodating respectively a month slide 24, a date slide 25, and a day slide 26. The slides or sticks 24–26 move vertically in the slots 21–23 respectively, and are provided with ample clearance so as to be movable freely vertically in a manner which presently will be described. The slots 21 and 22 have enlarged portions 21***a* and 22*a* for a purpose to be later specified.

The month slide 24, as clearly shown in FIG. 1, has indicia in spaced apart relation which designate consecutive months of the year in ascending order. The date slide 25 has ascending indicia from 1–31 in consecutive order designating the number of days in a month having the maximum number of days. Provided on the day slide 26 in spaced apart relation are ascending indicia designating the days of the week in consecutive order. While not shown in the view, it is to be understood that the dates used on slide 25 are from 1–31 and it is to be understood that the days of the week imprinted on slide 26 cover 5 weeks.

Figure 15:
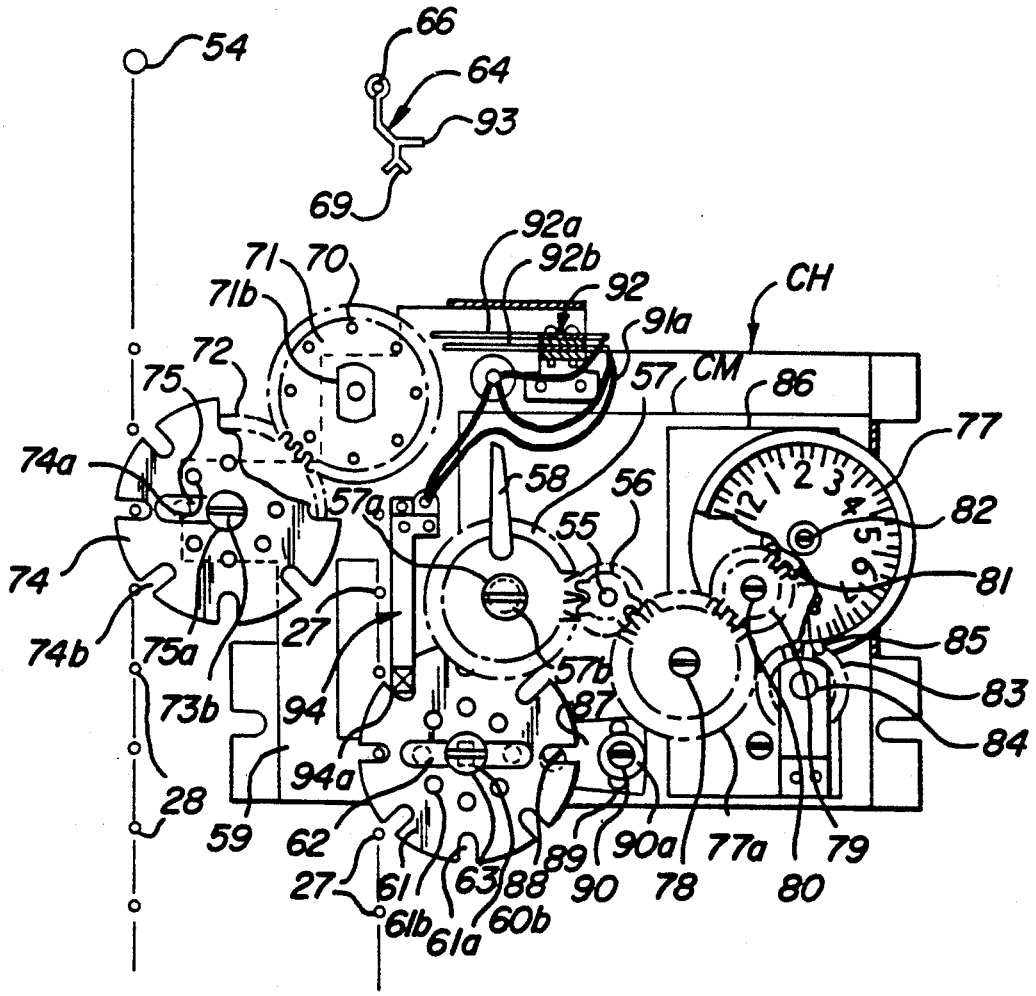
FIG. 15 is a partly schematic, front elevational view illustrating the mechanism for advancing the slides.

The indicia intervals of space on each of the slides 24–26 are equal and, as shown in FIG. 15, wherein the vertically spaced apart drive pins 27 on the rear face of slide 25, and the drive pins 28 on the rear face of slide 24, are shown schematically, the pin spacing is likewise the same. As will later become apparent, the clock motor, generally designated CM in FIG. 15, drives the slide 25 via pins 27 in a manner which will be described, and it is the slide 25 which powers the slides 24 and 26. The slides 24–26 move relatively to a datum line 29 which is imprinted on the front face 20*d* of the wall mount housing 20 to designate the current month, date and day of the week. As illustrated in FIG. 1, the reading is Jul. 31, a Sunday.

Figures 3, 4, 5, 6, 7:
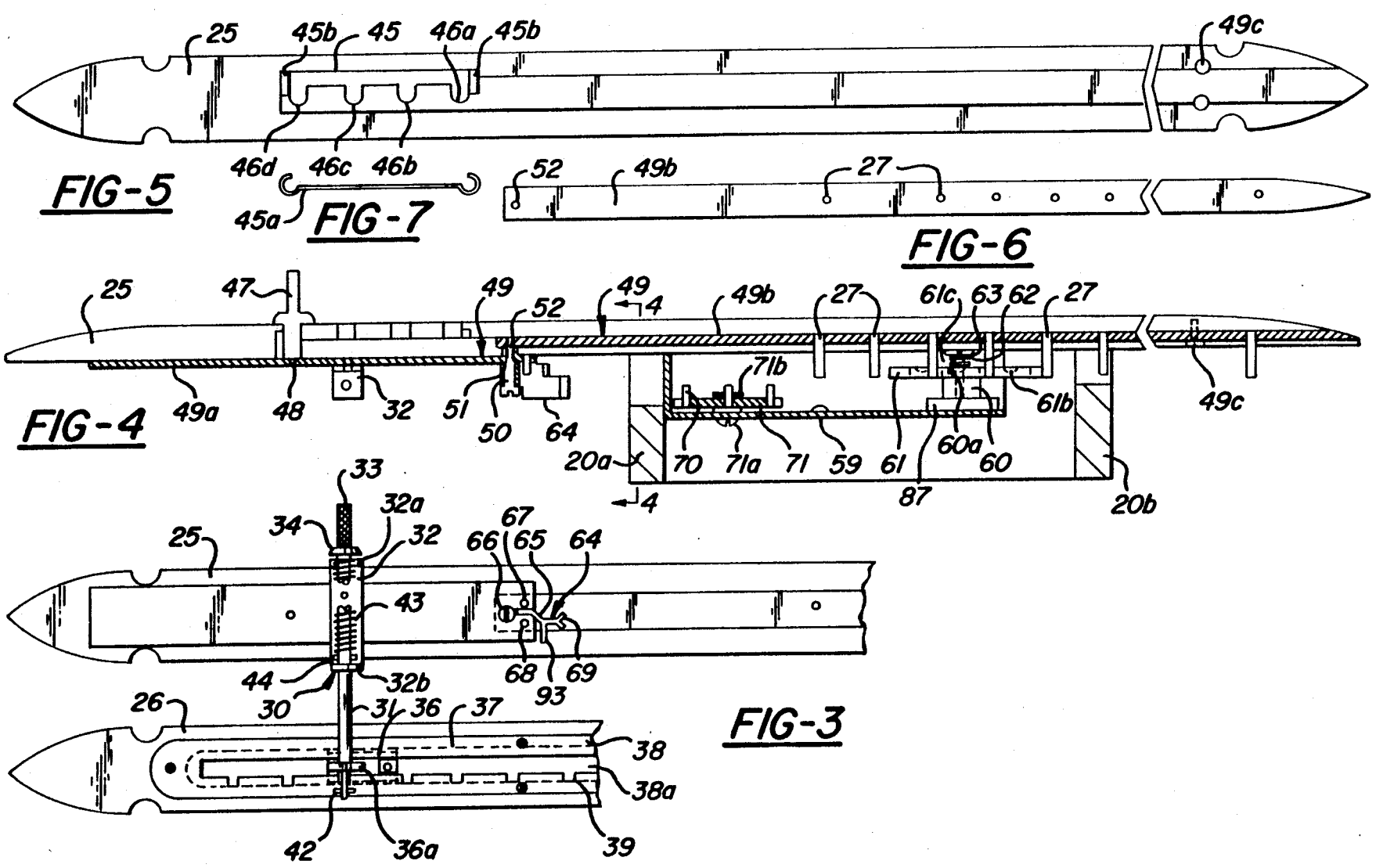
FIG. 3 is a fragmentary, sectional, rear elevational view of the date and day slide only, particularly illustrating the coupling which connects the pair of sticks in various positions of relative adjustment.
FIG. 4 is a sectional, elevational view taken on the line 4—4 of FIG. 1.
FIG. 5 is a top plan view of the rear face of the date slide only.
FIG. 6 is a rear elevational view of a drive pin-mounting insert strip forming a part of the date slide.
FIG. 7 is a top plan view of the leaf spring used on the date slide.

A coupling, generally designated 30, extends between the slides 25 and 26. As shown in FIG. 3 particularly, the coupling 30 includes a coupling pin 31 mounted on the slide 25 by a clevis fitting 32 having legs with openings 32*a* and 32*b* in which the pin 31 is freely laterally slideable. It will be noted that the pin 31 has a knurled end 33 mounting a stop collar 34 which limits travel of the pin 31 in one direction. The opposite end of pin 31 extends through an elongate slot 35 (FIG. 9) in the leg 36*a* of a sub-slide 36 carried by the date slide 26. The sub-slide 36 can travel longitudinally with respect to the slide 26 in a trackway 37 provided in slide 26. A plate 38 is received in the recess 26*a* to cover the trackway 37, and has a slot 38*a* for passing the upwardly extending slide leg 36*a* of sub-slide 36. Provided in the slot 38*a*, are a series of longitudinally spaced indents or offsets 39 for locating the sub-slide 36 in a given position. The leg 36*a* at its lower end carries a pin 40 which is normally received in one of the slots 39. Also fixed to the sub-slide 36 to extend beneath the sub-slide 36 is a leaf spring 41 which in normal position urges the sub-slide 36 outwardly toward the plate 38 and retains the pin 40 in the selected offset 39.

Provided in the opposite end of pin 31 is a pin 42 (FIG. 3), which is such a length as to pass through the elongate slot 35 provided in the slide leg 36*a* when it is desired to disassemble the coupling pin 31. Normally, a coil spring 43 is provided on the pin 31 between the legs of the clevis fitting 32. It connects at one end to a retention pin 44 extending through the pin 31 and serves to urge the pin 31 away from sub-slide 26 and retain the assembled position of the parts.

Provided in the upper end of slide 25 is a slot 45 (FIG. 1), having offsets 46 *a–d* respectively, identified by the date numbers 28, 29, 30 and 31. A retainer post 47 (FIG. 4) has a threaded lower end which threads into a threaded opening 48 provided in a slide plate assembly or sub-slide 49 which is mounted on the slide 25. The slide assembly 49 includes an outer part 49*a* and an inner part 49*b* on which the pins 27 are fixed. The slide assembly parts 49*a* and 49*b* are coupled by a screw pin 50, threaded into a threaded opening 51 provided in the part 49*a*, and having a free end secured in an opening 52 provided in the part 49*b*. The retaining pins 49*c* are provided to hold the strip 49*b* in position within its recess. Secured to slide 25 by its ends, which are captured underneath wall portions 45*b*, is a retainer leaf spring 45*a*. The purpose of spring 45*a* is to tend to urge the post 47 (FIG. 4) into one of the offsets 46*a*–46*d* and retain it in position. The post 47 could be, but need not be, clamped down on slide 25. Longitudinal adjustment of the sub-slide 49 on the slide 25 positions the pins 27 for the number of days in the current month.

Figure 14:
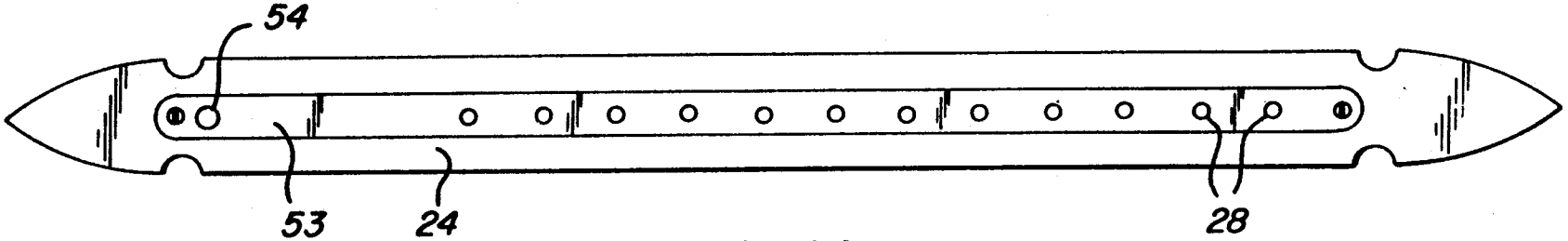
FIG. 14 is a rear elevational view of the month slide.
Figure 13:
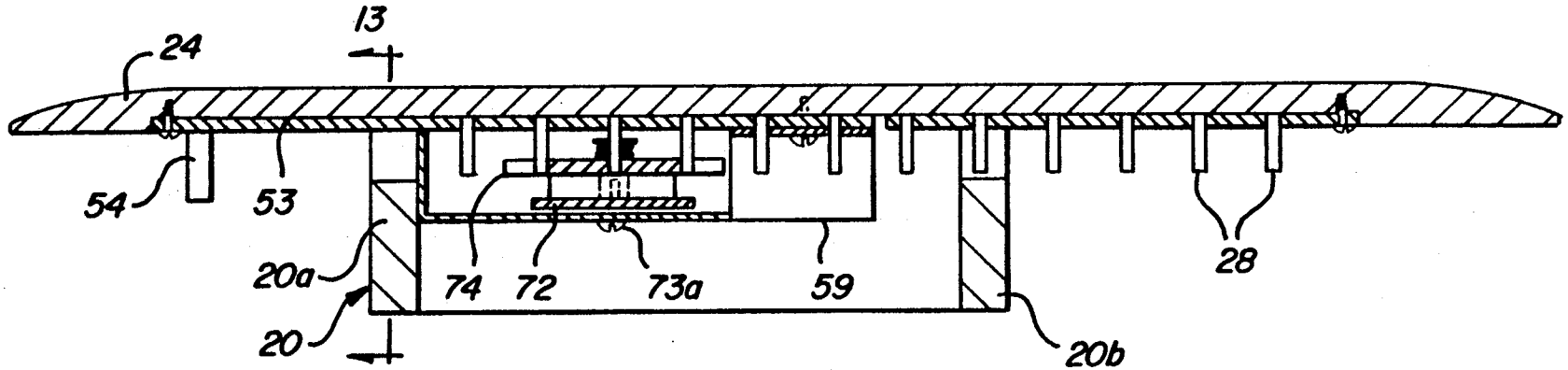
FIG. 13 is a schematic sectional elevational view taken on the line 13—13 of FIG. 1, with various parts omitted for the sake of convenience of illustration.

Referring now to FIGS. 13 and 14, the slide 24 on its rear face is recessed to mount a plate 53 upon which the pins 28 are provided in spaced relation as shown. The plate 53 also mounts a stop pin 54 which comes into engagement with the wall 20*a* at the end of the year when the month slide 24 has reached the lower limit of its travel to prevent it from falling out of the slot 21.

It is the drive spindle 55 (FIG. 15) of the conventional 24 hour clock motor CM which mounts a pinion gear 56 in mesh with a gear 57 secured on a shaft 57*b*, gear 57 having an actuator arm 58 fixed to it. The arm 58 engages the particular tooth 27 which is in its path and gradually, over approximately a two hour interval, moves the slide 25 downwardly, at which point it disengages from the pin 27 which it was driving and, over the remainder of the 24 hour interval, travels back to a position in which it engages the next tooth 27.

Provided on a support plate structure 59 fixed within the wall mount housing 20, is a stud member 60 (FIG. 4) providing a shaft portion 60*a* on which a slotted star wheel 61 having circumferentially spaced recesses 61*b* (FIGS. 15 and 18) is rotatable. A retainer plate 61*c* mounted on shaft portion 60*b* has detents 61*d* received in the recesses 61*b* and is spring maintained by a retention spring 62 secured by a screw 63 which threads into threaded opening 60*c*. The purpose of wheel 61 is to function as a retainer for receiving the pins 27 in consecutive circumferentially spaced peripheral slots 61*a*, and supporting the pins 27 so the slide 25 does not drop down out of the housing. In this way slide 25 remains at a particular position with respect to the datum line 29 until such time as the arm 58 moves the slide 25 downwardly to the next successive date over a several hour period, whence it remains in this position until it is once again engaged by the arm 58. The spring 62 simply bears on the plate 61*c* and wheel 61 to exert resilient pressure tending to maintain the detents 61*d* in recesses 61*b* and so maintain wheel 61 in a given position of rotation. However, the pressure of arm 58 is sufficient to force spring 62 outwardly and permit wheel 61 to revolve an increment, after which detents 61*d* reengage in the successive set of recesses 61*b*.

Provided on the date slide sub-slide 49 at a spaced predetermined distance above the teeth 27, and so also affected by relative longitudinal adjustment of the slide 25 and sub-slide 49, is an activator generally designated 64 (FIGS. 3 and 15) comprising an arm 65, pivotally mounted on a screw shaft 66 and prevented from rotating more than a slight increment by limit pins 67 and 68. One end of the arm 65 includes a yoke 69 adapted to engage one of the pins 70 (FIGS. 15 and 6) on a pinion gear 71 (FIGS. 15 and 17) which drives a pinion gear 72, rotatable on a shaft 73 secured to plate 59 by a screw 73*a*. As FIG. 16 indicates, gear 71 is mounted for rotation on plate 59 by a screw 71*a* received by a threaded retainer 71*b*. It is the yoke 69 which is responsible for moving the month slide 24 downwardly at the predesignated time to advance the month slide incrementally. The pinion gear 72 is fixed by rivets, or in any other acceptable manner, to a slide-advancing star wheel 74, which has slots 74*b* adapted to engage the pins or teeth 28 on slide 24, as shown in FIG. 15. Provided on a portion 73*b* of shaft 73 is a retainer plate 73*c* which has a detent 73*d* received in one of the circumferentially spaced recesses 74*a* provided in wheel 74. A leaf spring 75 is provided to bear on the plate 73*c*, and may be secured by a screw 75*a* received in threaded opening 73*e* in shaft 73, to normally frictionally retain the wheel 74 in a given position of rotation so that slide 24 does not drop out of the slide opening 21. The pressure exerted by gear 71, when it is driven, is sufficient to force spring 75 outwardly and permit wheel 74 to turn an increment, after which the detent 73*d* reengages in the next recess 74*a*.

To provide a visible indication of the hour through a window 76 (FIG. 1), an hour wheel 77 (FIG. 15) is driven from the clock motor shaft or spindle 55 and gear 56, by a gear 77*a* mounted on the shaft of a screw 78 via a gear 79 mounted on the shaft of a screw 80, and a gear 81, mounted on the same shaft portion of a screw 82 as the hour wheel 77. The setting wheel or gear 83 for wheel 77 is controlled by a manually operated push-pull shaft 84. The gear 83 can be pulled outwardly into mesh with the gear teeth 85 provided on the hour wheel 77, and can be returned to neutral position thereafter when setting has been accomplished. The entire gear train mechanism for wheel 77 is mounted on a housing plate 86.

The stud member 60, on which retention wheel 61 is mounted, is secured to a plate 87 which is pivoted on the shaft portion of a screw 88 (FIG. 19) fixed to plate 59. Because screw 88 extends through a slot 88*a* in plate 87, longitudinal adjustment of the position of plate 87 is possible. At its remote end, the plate 87 has an arcuate slot 89, and a screw 90, mounting a washer 90*a*, threads into the plate 59 to lock the plate 87 in a given position of arcuate adjustment. This adjustment permits the position of wheel 61, and the slots 61*a* therein, to be adjusted to align the datum bar with the dates.

All of the elements which have been described are carried on a chassis CH which is fixed inside the wall mount housing 20. Provided on the front wall of the wall mount housing 20, is a light L for illuminating the clock window 76 and, also provided, is a buzzer 91 which is set off, for example, when the date stick 25 reaches lowermost position for the current month. The switch for accomplishing this shown in FIG. 15 as a double blade switch 92 (having blades 92*a* and 92*b*) which is connected to power the buzzer 91, when closed. It is the arm 93 on the activator 64 which engages and closes switch 92. When the activator 64 descends, it is forced to pivot slightly on post 66 as the result of the rotary travel of pin 70 and this is sufficient to cause arm 93 to move over enough to force the upper blade 92*a* of the switch 92 into engagement with the lower blade 92*b* and set off the buzzer 91. At this point, it will be evident that the slides 25 and 26 need to be moved upwardly and relatively adjusted for proper date-day alignment (by depressing part 36*a*) and, if necessary, the positions of slide assembly 49 and coupling pin 30 need to be altered. Also capable of activating the buzzer 91, is an alarm switch 94, which is a similar double-bladed switch having an upstanding foot 94*a* on its one end. The foot 94*a* is depressed by the arm 58 to make the switch 94, which is wired in parallel to switch 92 to the buzzer 91 in the usual manner as at 91*a*.

The positioning of actuator arm 58 to control the time at which the alarm can be set to go off in the morning is controlled by engaging and rotating the push-pull knob 84. Provided in series circuit with the switch 94, is an on/off switch 95 which, when in a closed position, selectively puts the switches 92 or 94 in circuit with the buzzer. Switch 95 is the usual double throw, neutral center position, on/off switch. When the switch 95 is in the lower position (FIG. 1), the reset alarm circuit (switch 92) is operative and, when it is in the upper position, the clock alarm circuit (switch 94) is operative. It is "off" in the middle or neutral position as shown in FIG. 1. The entire electrical circuit may be battery or household current powered, or powered by some combination thereof.

THE OPERATION

In operation, the coupled date slide 25 and day slide 26 move downwardly an increment at twenty-four intervals, via the clock driven arm 58 engaging and advancing successive date slide pins 27. Via the control knob 84, the timing of this advancement will depend on the rotary positioning of arm 58 which can be set to awaken the household at a particular hour, if desired. The month slide 24 is only advanced an increment by actuator 64 when the date slide 25 drops beyond its last index. In this position, the retention wheel 61 supports the slides 25 and 26, until they are manually raised. When the date slide 25 in its last index drops, all three slides drop and the alarm 91 goes off, if switch 94 is in the lowermost "reset" alarm position, to indicate the need to reset. The slides 25 and 26 can be easily reset (raised) because the arm 58 has traveled around beyond the pins 27. Any adjustment of the day slide relative to the date slide can be accomplished by moving the slide 26 relative to sub-slide 36 to align the correct day of the week with the first date of the month.

If the ensuing month has a different number of days, the knob 47 is moved laterally against the retaining force of spring 45*a* to remove it from the particular opening 46*a*–46*d* in which it is engaged. It can then be moved vertically in the slot 45 to a position opposite the appropriate (offset opening) 46*a*–46*d* (labeled 28–31), whence spring 45*a* will reengage it in the appropriate opening. This movement repositions slide assembly 49, with its pins 27 and actuator 64, relative to slide 25, and, this necessarily repositions coupling pin 30 relative to slide 26. The adjustment enables actuator 64 to move month slide 24 downwardly at the proper time for the number of days in the current month.

Although preferred embodiments of the invention have been illustrated in the accompanying drawings and described in the foregoing detailed description, it will be understood that the invention is not limited to the embodiments disclosed, but is capable of numerous rearrangements, modifications and substitutions of parts and elements without departing from the spirit of the invention which is defined in the following claims.

What is claimed is:

1. A motorized slide stick calendar comprising:

a. a wall mount having a series of side by side slide openings and a datum;

b. slides, including at least a day slide, with longitudinally spaced days of the week visible thereon at equal intervals, and a date slide, with longitudinally spaced numbers designating days of the month visible thereon and spaced the same equal intervals, reciprocably received in said slide openings;

c. said date slide having numbers from one to thirty-one;

d. connecting means coupling said date slide with said day slide for coincident motorized movement, said connecting means being carried by one of said slides and longitudinally slideably mounted by the other slide to accommodate relative longitudinal adjustment of said date slide and day slide;

e. clock motor means connected to drive said slides relative to said datum to display the day and date at said datum and index the slides during successive twenty-four hour periods to display subsequent days and dates.

2. The calendar defined in claim 1 wherein said other of said slides includes a sub-slide which is longitudinally adjustable thereon, said connecting means is carried by said sub-slide; and retaining means is provided for maintaining said connecting means in an adjusted relative position locating said slides in a selected relative position.

3. The calendar of claim 1 wherein a month slide having longitudinally spaced months of the year indicia thereon is carried by said wall mount, said date slide has a sub-slide with a month slide actuator thereon, and retaining means for enabling adjustment of the position of said sub-slide with respect to said date slide includes a longitudinal slot in said date slide having offsets identified as the date numerals 28, 29, 30 and 31, and a keeper on said sub-slide is received in one of said offsets dependent on the number of days in the current month.

4. The calendar of claim 1 wherein one of said slides carries a sub-slide with a clock motor means driven actuator thereon, and one of said sub-slide and slide carry indicia permitting relative adjustment of said sub-slide and slide to relative positions corresponding to months having different numbers of days.

5. The calendar of claim 1 in which said date slide has longitudinally spaced teeth on its one face spaced at said intervals, and said clock motor means connects with and drives said teeth.

6. The calendar of claim 5 wherein said teeth are on a sub-slide carried by said date slide which is adjustable thereon relative to indicia indicating the different relative positions in which the slide and sub-slide should be for months having 28–31 days.

7. The calendar of claim 1 wherein a month slide, having months of the year spaced longitudinally thereon at said same intervals, is reciprocably received in another of said slide openings, and indexing means carried by one of said slides is provided for moving said month slide a distance corresponding to one of said intervals when the said one slide reaches the end position of its travel.

8. The calendar of claim 1 wherein alarm means is connected to be activated when said slides are indexed through successive twenty-four hour periods corresponding to the number of days in a current month.

9. The calendar of claim 1 wherein one of said slides has a row of longitudinally spaced apart teeth thereon spaced at said intervals, and said clock motor, drives actuator means with an intersecting path of rotation relative to said row to engage one of said teeth and move it to drive said one slide through an interval of movement corresponding to one of said intervals during each twenty-four hour period.

10. The calendar of claim 9 wherein alarm switch means is provided in the path of said actuator means and the relative drive positions of said actuator means and clock motor means are adjustable to vary the time at which said actuator means reaches said alarm switch means.

11. The calendar of claim 9 wherein an alarm switch activator is provided on said one slide above said row, and an alarm switch is mounted on said wall mount in position to be operated thereby when said one slide reaches the end position of its travel for the current month.

12. A motorized slide stick calendar comprising:

a. a wall mount having a series of side by side slide openings and a datum;

b. slides, including a date slide with longitudinally spaced numbers designating days of the month visible thereon and spaced at equal intervals reciprocably received in one of said slide openings, and a month slide with longitudinally spaced indicia indicating successive months of the year at said intervals received in still another slide opening;

c. said date slide having numbers from one to thirty-one; and d. clock motor means connected to drive said date and month slides relative to said datum to display the date and month at said datum.

13. The calendar defined in claim 12 wherein said date slide includes a sub-slide which is longitudinaly adjustable thereon, month slide actuator means is carried by said sub-slide for movement therewith relative to the date slide; and retaining means is provided for maintaining said actuator means in an adjusted position locating said date slide and sub-slide in different relative positions corresponding to a month having twenty-eight, twenty-nine, thirty, and thirty-one days.

14. The calendar of claim 13 wherein said retaining means includes a longitudinal slot in said date slide having offsets identified by the numerals 28, 29, 30 and 31, and a keeper on said sub-slide is received in one of said offsets dependant on the number of days in the month.

15. The calendar of claim 12 in which said date slide has longitudinally spaced teeth on its rear face spaced at said intervals, and said clock motor means connects with and drives an actuator in driving engagement with said slide teeth.

16. A motorized slide stick calendar comprising:

a. a wall mount having a slide opening and a datum;

b. a date slide, with longitudinally spaced indicia designating days of the month from one to thirty-one visible thereon and spaced at equal intervals, received in said slide opening;

c. a sub-slide carried by said data slide and having relative movement therealong to various positions;

d. a clock motor drive;

e. clock motor driven means on said sub-slide driven by said drive to index said slide relative to said datum during successive twenty-four hour periods to display subsequent dates at said datum; and f. indicia carried on one of said slide and sub-slide permitting adjustment of their relative positions to position the clock motor drive means on the sub-slide for months having 28, 29, 30, or 31 days.

17. A motorized slide stick calendar as set forth in claim 16 wherein the wall mount has another slide opening, and a month slide with longitudinally spaced indicia designating months of the year are visible thereon and spaced at equal intervals, and indexing means is carried by said date slide for moving said month slide a distance corresponding to one of said intervals when said date slide reaches the end portion of its travel.

18. The motorized slide stick calendar defined in claim 16 wherein a first alarm switch means is provided in the path of said date slide and an alarm system is provided to be operated thereby when said date slide reaches the end of its travel for the current month, and wherein a second alarm switch means is provided in conjunction with said clock motor means to operate said alarm system at a given time each day when said date slide is indexed.

19. A method of operating a motorized slide stick calendar comprising a wall mounted housing having a slide opening and a datum, a date slide with longitudinally spaced indicia designating days of the month from 1 to 31 visible thereon and spaced at equal intervals, a sub-slide carried by said date slide and having relative movement there along to various positions, a clock motor drive, clock motor driven means on the sub-slide driven thereby to index the slide relative to said datum during successive twenty-four hour periods to display subsequent dates, and indicia carried on said date slide indicating adjustment of the relative positions of the sub-slide and date slide to position the clock motor drive means on the sub-slide for months having selectively 28, 29, 30, or 31 days, comprising the steps of:

a. moving the slide and sub-slide relatively to position the clock motor driven means for a month having thirty days;

b. driving the clock motor drive to index the date slide one interval during each twenty-four hour period;

c. returning the slide at the end of the thirty day period; and d. moving the slide and sub-slide relatively to position the clock motor drive means for a month having thirty-one days.

20. The method of claim 19 wherein said wall mount also mounts a month slide having successive months of the year thereon at said intervals and including the step of:

a. engaging the month slide from the date slide during the end portion of the travel of the date slide to index it an interval relative to said datum.

21. The method of claim 19 wherein said wall mount also mounts a day slide having successive days of the week thereon at said intervals and including the step of:

a. coupling the date and day sticks to index them concurrently.

* * * * *